United States Patent [19]

Khe et al.

[11] Patent Number: 4,699,862

[45] Date of Patent: Oct. 13, 1987

[54] ELECTROPHOTOCONDUCTOR

[75] Inventors: Nguyen C. Khe, Rochester, N.Y.; Masanobu Nakamura, Tokyo, Japan; Midori Fukawatase, Tokyo, Japan; Kenji Takahashi, Tokyo, Japan

[73] Assignee: Dainippon Ink and Chemicals, Inc., Tokyo, Japan

[21] Appl. No.: 880,627

[22] Filed: Jul. 1, 1986

[30] Foreign Application Priority Data

Jul. 2, 1985 [JP] Japan ..... 60-145445

[51] Int. Cl.[4] ..... G03G 5/087

[52] U.S. Cl. ..... 430/93

[58] Field of Search ..... 430/93

[56] References Cited

U.S. PATENT DOCUMENTS 4,418,135 11/1983 Beesow et al. ..... 430/93

FOREIGN PATENT DOCUMENTS 60-194460 10/1985 Japan .
60-241059 11/1985 Japan .
60-195548 11/1985 Japan .
60-241060 11/1985 Japan .
60-237454 11/1985 Japan .
61-110148 5/1986 Japan .
61-110147 5/1986 Japan .
61-110146 5/1986 Japan .
61-137154 6/1986 Japan .
61-110145 6/1986 Japan .
61-140943 6/1986 Japan .
61-137155 6/1986 Japan .
60-156132 10/1986 Japan .

*Primary Examiner*—J. David Welsh

*Attorney, Agent, or Firm*—Armstrong, Nikaido, Marmelstein & Kubovcik

[57] ABSTRACT

An electrophotoconductor comprising a photosensitive layer containing (a) a zinc oxide compound, (b) a phthalocyanine compound, (c) a hole transporting material and (d) a binder resin.

5 Claims, 1 Drawing Figure

ELECTROPHOTOCONDUCTOR

FIELD OF THE INVENTION

1. Background of the Invention

The present invention relates to an electrophotoconductor for electrophotography having high sensitivity in a wavelength range including wavelengths of semiconductor laser light. More particularly, the present invention relates to an inexpensive electrophotoconductor which is suitable for use as a material for making printing plates by employing a platemaking system equipped with a simiconductor laser as a recording light source.

2. Prior Art

Different recording light sources are used depending upon the spectral sensitivity of a specific electrophotoconductor. Systems employing gas lasers (e.g. Ar laser and He-Ne laser) as recording light sources are capable of forming images in comparatively short periods of time because of the high power outputs of these lasers. However, these systems require complicated optics and sophisticated maintenance technology, which makes it difficult for them to be made available in small size and at low cost.

With a view to developing recording light sources that satisfy the requirements for a compact and inexpensive system, active efforts are being made to commercialize systems employing semiconductor lasers as recording light sources. The present advances in semiconductor laser technology have been remarkable and those having oscillation wavelengths longer than 780 nm have been commercialized. Most of the semiconductor lasers currently operating as recording light sources feature oscillation wavelengths within the range of 780–850 nm.

Very recently, platemaking systems that employ as recording light sources semiconductor lasers having oscillation wavelengths in the range of 750–850 nm have been commericalized. Electrophotoconductors that are suitable for use as materials for making printing plates by employing such semiconductor lasers as recording light sources must satisfy at least the following three requirements:

(1) the image and non-image areas which are necessary for printing purposes are readily formed;

(2) the electrophotoconductor is produced at low cost; and (3) the electrophotoconductor has high sensitivity to semiconductor laser light.

Various techniques have been proposed for producing electrophotoconductors which are suitable for use as materials for making printing plates and which yet have high photosensitivity to semiconductor laser light. However, the heretofore proposed electrophotoconductors employ special photoconductive materials and cannot be manufactured at low cost. In order for electrophotoconductors to be used as materials for making plates suitable for both heavy-duty printing (as that of newspaper) and light-duty printing, said electrophotoconductors must be offered in the market at low cost.

SUMMARY OF THE INVENTION

The principal object, therefore, of the present invention is to provide an inexpensive electrophotoconductor which is suitable for use as a material for making printing plates and which yet exhibits high sensitivity to semiconductor laser light.

This object of the present invention can be attained by an electrophotoconductor which has a photosensitive layer wherein (a) a zinc oxide compound, (b) a phthalocyanine compound and (c) a hole transporting material are dispersed in (d) a binder resin.

DETAILED DESCRIPTION OF THE INVENTION

Figure 1:
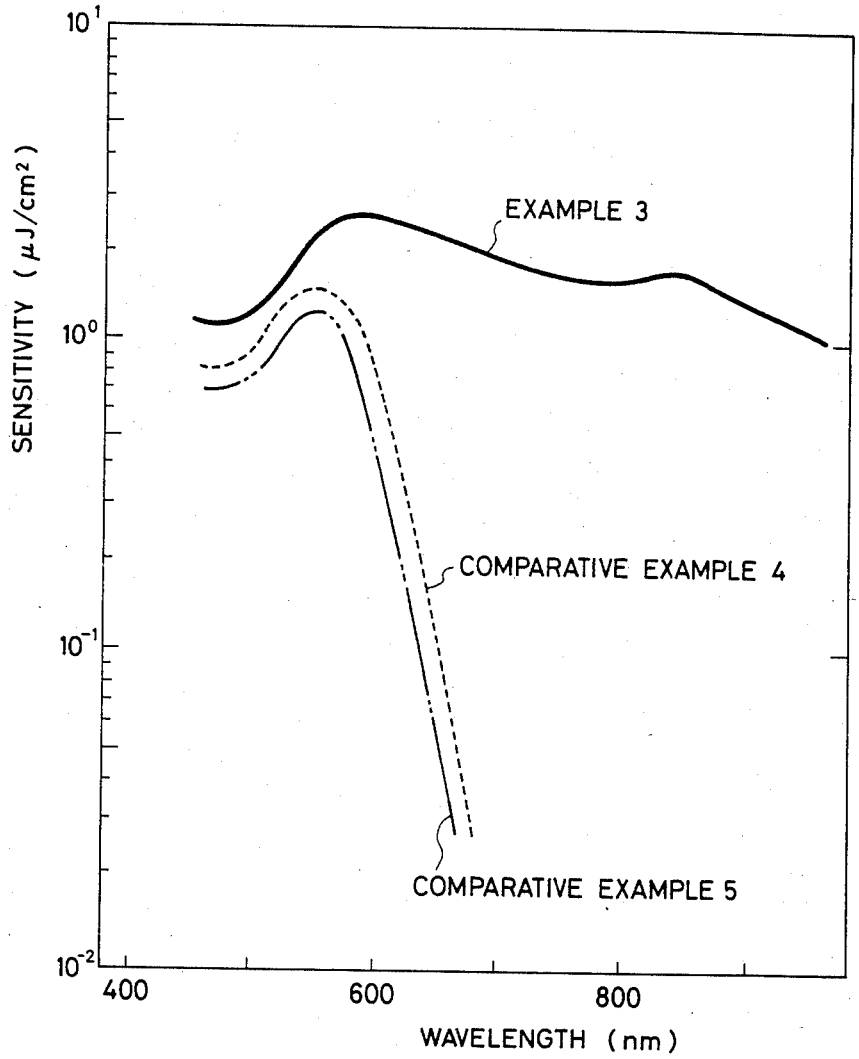
FIG. 1 is a chart showing the spectral sensitivities of the samples of electrophotoconductors which are prepared in Example 3 and Comparative Examples 4 and 5.

A zinc oxide compound which is suitable for use in the present invention may be the zinc oxide that is prepared by any of the standard methods such as the indirect (French) process and the direct (American) process. Zinc oxide sensitized by dye is particularly preferable.

The phthalocyanine compound which is suitable for use in the present invention may be metallic or non-metallic phthalocyanine or aromatic substituted derivatives thereof. Preferable examples are listed below.

(I)

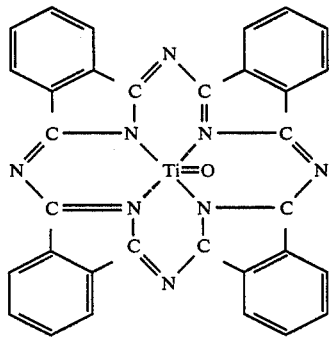

(II)

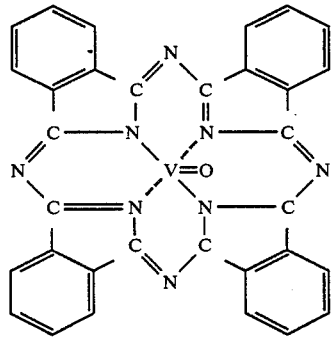

(III)

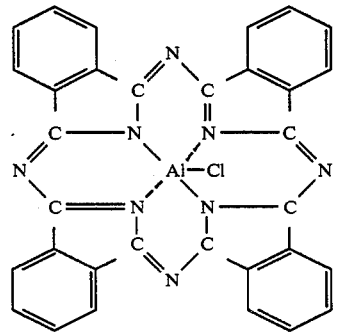

-continued (IV)

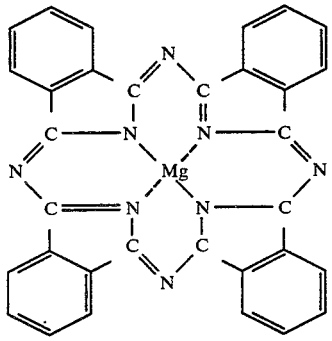

or (V)

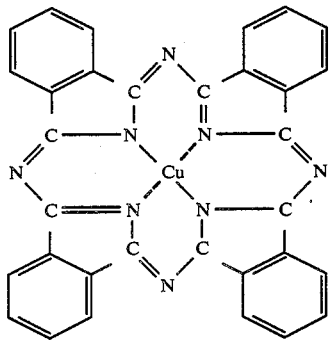

Also advantageous are phthalocyanine compounds wherein at least part of the four benzene nuclei in each of the metallic phthalocyanine compounds (I) to (V) is substituted by a halogen atom, a nitro group, an amino group or an optionally substituted alkyl, aralkyl or an aryl group.

The hole transporting material used in the present invention may be selected from among known hole transporting materials which have been used in electrophotographic materials. Suitable examples include: oxadiazole compounds such as 2,5-bis(4-dimethylaminophenyl)-1,3,4-oxadiazole 2,5-bis(4-diethylaminophenyl)-1,3,4-oxadiazole 2,5-bis(4-aminophenyl)-1,3,4-oxadiazole, 2-(4'-aminostyryl)-5-phenyl-1,3,4-oxidiazole, 2-(4'-aminostyryl)-5-(4''-methylphenyl)-1,3,4-oxidiazole , and the like; N-alkylcarbazole compounds such as N-methylcarbazole, N-ethylcarbazole, N-propylcarbazole and the like; dialkylaminobenzoic acid compounds such as dimethylaminobenzoic acid, diethylaminobenzoic acid, dipropylaminobenzoic acid and the like; and indole compounds such as 2-methylindole, 3-methylindole, 2-ethylindole, 2-phenylindole, 3-indoleacetone, indoxole and the like. Oxadiazole compounds and N-alkylarbazole compounds are preferable, with 2,5-bis(4-diethylaminophenyl)-1,3,4-oxadiazole and N-ethylcarbazole being particularly preferable.

Any of the known materials which have been used as binder resins in electrophotographic materials may be used in the present invention. Advantageous examples include: vinyl polymers such as ploystyrene, polyacrylamide, poly(N-vinylcarbazole), styrene-maleic acid copolymers, vinyl acetate-maleic acid copolymers and the like; copolymers of polymerizable monomers, such as acrylic monomers, vinyl acetate monomers, styrene momomers, vinyl chloride monomers and the like, and carboxyl-containing polymerizable monomers such as acrylic acid, methacrylic acid, maleic acid, fumaric acid, itaconic acid and the like; and resins such as polyamide, polyester, epoxy, phenoxy, polycarbonate resins and the like.

In preparing the photoconductor of the present invention, the particles of (a) the zinc oxide compound, (b) the phthalocyanine compound and (c) the hole transporting material may be pulverized into a smaller size by an appropriate mechanical means such as an attritor, ball mill, etc. This is effective for improving the dispersibility of these compounds in a coating and for preparing a photoconductor having high electron-accepting capability.

In accordance with the present invention, for example, the fine particles of the compounds (a) to (c) are added to a solution of the binder resin in an appropriate organic solvent; the components are uniformly dispersed with a dispersing machine such as a ball mill, paint shaker, or an ultrasonic disperser; and the resulting dispersion is applied to an electrically conductive substrate and dried, thereby providing the electrophotoconductor of the present invention. Coating is typically performed with a roll coater, wire bar coater or a doctor blade coater.

Examples of suitable solvents include: aromatic hydrocarbons such as benzene, toluene, etc.; ketones such as acetone, butanone, etc.; halogenated hydrocarbons such as methylene chloride, chloroform, etc.; ethers such as ethyl ether, etc.; cyclic ethers such as tetrahydrofuran, dioxane, etc.; and esters such as ethyl acetate, methyl cellosolve acetate, etc. These solvents may be used either alone or in admixture.

The photosensitive layer has a thickness which preferably ranges from 3 to 50 μm, more preferably from 3 to 15 μm.

The zinc oxide compound (a), the phthalocyanine compound (b), the hole transporting material (c), and the binder resin (d) are preferably mixed at such proportions that 0.1–30 parts by weight of (b), 0.1–30 parts by weight of (c) and 10–100 parts by weight of (d) are present for 100 parts by weight of (a).

An electrically conductive support suitable for use with the photoconductor of the present invention may be selected from among metallic (e.g. aluminum) plates, foils, plastic films on which a metal (e.g. aluminum) layer is deposited by evaporation, and paper which has been rendered electrically conductive.

The photoconductor thus prepared may have an adhesive or barrier layer formed between the conductive support and the photosensitive layer as required. The adhesive or barrier layer may be formed of polyamide, nitrocellulose, casein, polyvinyl alcohol, or any other suitable materials.

When a printing plate is made from the photoconductor of the present invention, image and non-image areas may be formed by one of the following two methods according to the materials of the conductive support.

The first method is suitable when the plate is to be used in light-duty printing where comparatively short runs are intended as in-house printing. The support for the photoconductor which is suitable for working by this method is paper impregnated with an electroconductive resin. A toner image is formed on the photoconductor with an electrophotographic apparatus using a semiconductor laser as a recording light source; the toner image is fixed; and the surface of the photoconductor is treated with a processing solution containing potassium ferrocyanide. The zinc oxide exposed in non-image areas will then react with the potassium ferrocyanide, thereby rendering hydrophilic the surface of the photosensitive layer in the non-image areas. The image areas, on the other hand, where the toner image has been formed will remain lipophilic (ink-receptive). The printing plate thus prepared may be used as a lithographic printing plate with dampening solution being supplied.

The second method is suitable when the plate is to be used in heavy-duty printing where long runs are required as in the printing of newspaper. The photoconductor which is suitable for working by this second method uses a sand-blasted metallic plate, preferably a sand-blasted aluminum plate, as the conductive support and incorporates an alkali-soluble resin as the binder resin. Usable alkali-soluble resins include styrene-maleic acid copolymers, and coplymers of polymerizable monomers, such as acrylic, vinyl actate, styrenemet, vinyl monomers, etc. and carboxyl-containing polymerizable monomers such as acrylic acid, maleic acid, fumaric acid, itaconic acid, etc. A toner image is formed on the photoconductor with an electrophotographic apparatus using a semiconductor laser as a recording light source. The toner image is fixed and the surface of the photoconductor is developed with an alkaline aqueous solution which contains sodium hydroxide, sodium silicate, etc. as an alkali agent, whereupon the photosensitive layer in the non-image areas are stripped away, leaving only the toner image in the photosensitive layer. During printing, the remaining toner image serves to form image areas while the bare metallic surface works as non-image areas. The so prepared photoconductor may also be used as a lithographic printing plate with dampening water being supplied.

The mechanism by which the electrophotoconductor of the present invention is sinsitized will be briefly described hereinafter. The phthalocyanine compounds reported heretofore are hole transporting materials. Photosensitive layers prepared by uniformly dispersing these phthalocyanine compounds into binder resins exhibit high sensitivity when they are positively charged while, if they are negatively charged, they are unable to retain adequate amounts of charges since holes are injected and transported from the support electrode. This phenomenon is most undesirable in platemaking systems using semiconductor lasers as recording light sources. Even photosensitive layers formed by dispersing phthalocyanine compounds within a hole transport media containing charge carrier transporting materials (e.g. oxaidazole, hydrozone compounds or pyrazoline compounds) in binder resins exhibit fairly high residual potentials when they are charged negatively.

On the other hand, photoconductors wherein zinc oxide, either alone or in combination with hole transporting materials, is dispersed in binder resins have little sensitivty at wavelengths longer than 780 nm.

Under these circumstances, photoconductors wherein zinc oxide and phthalocyanine compounds are dispersed in binder resins have been studied. Photoconductors of this type are unable to possess high sensitivity unless they contain large amounts of phthalocyanine compounds. However, as more phthalocyanine compounds are incorporated with a view to providing a higher sensitivity, the ability of the surface of the photoconductor to retain water and its hydrophilicity is reduced. In addition, the ability of the photoconductor to retain negative charges is lowered since holes will be injected from the substrate with high efficiency when the photoconductor is negatively charged.

However, if, in accordance with the present invention, a phthalocyanine compound and a hole transporting material are added to the photosensitive layer wherein zinc oxide is dispersed in a binder resin, the sensitivity of the photoconductor to longer wavelength light is markedly increased compared with the conventional photoconductor wherein zinc oxide is dispersed in a binder resin. This fact suggests that if the photoconductor of the present invention is illuminated under light having wavelength longer than 780 nm, electric interaction occurrs between zinc oxide, phthalocyanine compound and the hole transporting material and the phthaloyanine is excited to enable the generation and transport of charge carriers, thereby allowing the photoconductor to have high sensitivity in the longer wavelength range.

The following examples are provided for the purpose of further illustrating the present invention. It should however be noted that various other modifications may be made to the present invention without departing from its scope and spirit. In the following examples, all "parts" are by weight unless otherwise specified.

EXAMPLE 1

Zinc oxid (2640 parts; Sazex #2000 of Sakai Chemical Industry Co., Ltd.), 20 parts of a titanyl phthalocyanine compound of formula (I) and 150 parts of 2,5-bis(4-diethylaminophenyl)-1,3,4-oxadiazole were added to 660 parts of a binder polyvinyl acetate resin (Product No. 28-2930 of National Strarch and Chemical Corportion; $Mw=2\times10^4$) in 5500 parts of a mixed solvent of methyl ethyl ketone and methylene chloride, and were unformily dispersed by means of a paint shaker. The resulting photosensitive coating solution was applied to a sand-blasted aluminum plate with wire bar coater and the web was dried to produce an electrophotoconductor having a photosensitive layer with a thickness of 15 μm. The charging characteristics and the photosensitivity of the so prepared photoconductor were evaluated by the following procedures with a Paper Analyzer SP-428 (Kawaguchi Electric Works Co., Ltd.).

The surface of the photoconductor sample was charged to a negative voltage of 6 kilovolts. The surface potential in volts of the sample was measured immediately after voltage impression ($V_0$) and 10 seconds after the impression was removed ($V_{10}$). The ability of the sample to retain negative charges was evaluated in terms of $V_{10}/V_0$.

The charged surface of the sample was exposed to white light under a tungsten lamp and thereafter the sensitivity of the sample was evaluated by measuring the following parameters: $E_{\frac{1}{2}}$ (lux·sec), or the exposure required for the initial surface potential of the sample having received an exposure density of 5 lux to be reduced by half; $E_{1/5}$ (lux·sec), or the exposure required for the surface potential of the sample to be decreased to a fifth of the initial value $V_{R15}$ (V), or the surface potential measured 15 seconds after the start of exposure; and $E_{\frac{1}{2}}$ (J/cm$^2$), or the photosensitivity of the sample which was illuminated by spectral light (intensity, 10 mW/m$^2$) at 830 nm. Based on these physical quantities, the sensitivity of the sample was evaluated and the results are summarized in Table 1.

TABLE 1

| Example | $V_{0(V)}$ | $V_{10(V)}$ | $V_{10}/V_0$ | $E_{\frac{1}{2}}$ (lux. sec) | $E_{1/5}$ (lux. sec) | $E_{\frac{1}{2}}$ at 830 nm ($\mu J/cm^2$) | $V_{15(V)}$ |
|---|---|---|---|---|---|---|---|
| 1 | −620 | −590 | 0.95 | 6.0 | 10.0 | 2.0 | 0 |

EXAMPLE 2

A mixture of zinc oxide (100 parts; Sazex #2000 of Sakai Chemical Industry Co., Ltd.), Rose Bengal (0.5 part; Xanthene dye) and methanol (300 parts) was ball-milled with ceramic beads for 24 hours. Thereafter, methanol was evaporated to obtain a powder of dye-sensitized ZnO. Using ZnO powder thus sensitized, a photoconductor sample was prepared as in Example 1. The characteristics of the sample are summarized in Table 2.

TABLE 2

| Example | $V_{0(V)}$ | $V_{10(V)}$ | $V_{10}/V_0$ | $E_{\frac{1}{2}}$ (lux. sec) | $E_{1/5}$ (lux. sec) | $E_{\frac{1}{2}}$ at 830 nm ($\mu J/cm^2$) | $V_{15(V)}$ |
|---|---|---|---|---|---|---|---|
| 2 | −560 | −500 | 0.89 | 1.0 | 2.0 | 0.8 | 0 |

COMPARATIVE EXAMPLES 1 TO 2

Photoconductors were prepared as in Example 1 from the formulations shown in Table 3. The characteristics of each comparative sample were measured and the results are also shown in Table 3.

TABLE 3

| | Comparative Example 1 | Comparative Example 2 | Comparative Example 3 |
|---|---|---|---|
| Formulation | | | |
| $ZnO_2$ | — | — | 2640 |
| Titanyl phthalocyanine compound (parts) | 20 | 20 | 20 |
| 2,5-Bis(4-diethylaminophenyl)-1,3,4-oxadiazole (parts) | 150 | — | — |
| Binder Resin "28-2930"(parts) | 660 | 660 | 660 |
| Photoreceptor's Characteristics | | | |
| $V_{0(V)}$ | −800 | −790 | −600 |
| $V_{10(V)}$ | −780 | −780 | −540 |
| $V_{10}/V_0$ | 0.97 | 0.98 | 0.90 |
| $E_{\frac{1}{2}}$ at 830 nm ($\mu J/cm^2$) | 30.0 | 28.0 | 6.0 |
| $E_{1/5}$ at 830 nm ($\mu J/cm^2$) | — | — | 10.0 |
| $V_{R15(V)}$ | 500 | 450 | 30 |

EXAMPLES 3 AND COMPARATIVE EXAMPLES 4 TO 6

Additional photoconductors were prepared in a same way as in Example 1 with the formulations shown in Table 4. The spectral sensitivities of the respective samples were measured and the results are shown in FIG. 1.

TABLE 4

| | Example 3 | Comparative Example 4 | Comparative Example 5 |
|---|---|---|---|
| $ZnO_2$ (sensitized with Rose Bengal) (parts) | 2640 | 2640 | 2640 |

TABLE 4-continued

| | Example 3 | Comparative Example 4 | Comparative Example 5 |
|---|---|---|---|
| Titanyl phthalocyanine compound (parts) | 150 | — | |
| 2,5-Bis(4-diethyl aminophenyl)-1,3,4-oxadiazole (parts) | 20 | — | — |
| Binder Resin* (parts) | 650 | 650 | 650 |
| Mixed Solvents of toluene and ethyl ketone (parts) | 3000 | 3000 | 3000 |

*Dianal BR-96, of Mitsubishi Rayon Co., Ltd. Thermoplastic acrylic resin: MW = 155,000

EXAMPLES 4 TO 8

Additional photoconductors were prepared in a same way as Example 2 except that the titanyl phthalocyanine was replaced by the phthalocyanine compounds listed in Table 5. The characteristics of the respective samples were measured and the results are summarized in Table 5.

COMPARATIVE EXAMPLES 6 TO 10

Additional photoconductors were prepared in a same way as in Comparative Example 3 except that the titanyl phthaloxyanine was replaced by the phthalocyanine compounds listed in Table 5. The characteristics of the respective samples were measured and the results are summarized in Table 5.

TABLE 5

| Run No. | Phthalocyanine Compound | λ max** | $V_{0(V)}$ | $E_{\frac{1}{2}}$ at λ max |
|---|---|---|---|---|
| Example 1 | Formula (II) | 820 | −600 | 0.8 |
| Example 5 | Formula (III) | 800 | −580 | 0.6 |
| Example 6 | Formula (IV) | 850 | −620 | 0.8 |
| Example 7 | Non-metallic phthalocynanine | 780 | −540 | 0.8 |
| Example 8 | Formula (V) | 780 | −590 | 1.0 |
| Comparative Example 6 | Formula (II) | 820 | −610 | 8.0 |
| Comparative Example 7 | Formula (III) | 800 | −590 | 9.0 |
| Comparative Example 8 | Formula (IV) | 850 | −630 | 8.0 |
| Comparative Example 9 | Non-metallic phthalocyanine | 780 | −560 | 10.0 |
| Comparative Example 10 | Formula (V) | 780 | −600 | 10.0 |

**Maximum absorption wavelength longer than 700 nm.

EXAMPLE 9

An additional photoconductor was prepared as in Example 1 except that the oxadiazole compound was replaced by N-ethylcarbazole. The characteristics of the sample were measured and the results are summarized in Table 6.

TABLE 6

| Example | $V_{0(V)}$ | $V_{10(V)}$ | $V_{10}/V_0$ | $E_{\frac{1}{2}}$ (lux. sec) | $E_{1/5}$ (lux. sec) | $E_{\frac{1}{2}}$ at 830 nm ($\mu J/cm^2$) | $V_{15(V)}$ |
|---|---|---|---|---|---|---|---|
| 10 | −590 | −494 | 0.84 | 1.7 | 3.4 | 1.8 | 0 |

EXAMPLE 10

An additional photoconductor was prepared as in Example 2 except that the oxadiazole compound was replaced by N-ethylcarbazole. The characteristics of the sample were measured and the results are summarized in Table 7.

TABLE 7

| Example | $V_{0(V)}$ | $V_{10(V)}$ | $V_{10}/V_0$ | $E_{\frac{1}{2}}$ (lux. sec) | $E_{1/5}$ (lux. sec) | $E_{\frac{1}{2}}$ at 830 nm ($\mu J/cm^2$) | $V_{15(V)}$ |
|---|---|---|---|---|---|---|---|
| 9 | −564 | −502 | 0.89 | 4.0 | 10.0 | 1.9 | 0 |

EXAMPLE 11

Zinc oxide (2000 parts), 300 parts of a titanyl phthalocyanine compound of formula (I) and 40 parts of 2,5-bis(4-diethylaminophenyl)-1,3,4-oxadiazole were added to 650 parts of a binder acrylic resin (Dianal BR-96 of Mitsubishi Rayon Co., Ltd.; thermoplastic acrylic resin, MW=155,000) in 3000 parts of a mixed solvent of toluene and methyl ethyl ketone, and were uniformly dispersed by means of a paint shaker. The resulting photosensitive coating solution was worked as in Example 1 to make a photoconductor. The characteristics of the sample were measured and the results are summarized in Table 8.

EXAMPLE 12

Zinc oxide (1500 parts), 300 parts of a titanyl phthalocyanine compound of formula (I) and 40 parts of 2,5-bis(4-diethylaminophenyl)-1,3,4-oxadiazole were added to 650 parts of a binder acrylic resin (Dianal BR-96 of Mitsubishi Rayon Co., Ltd.; thermoplastic acrylic resin, MW=155,000) in 3000 parts of a mixed solvent of toluene and methyl ethyl ketone, and were uniformly dispersed by means of a paint shaker. The resulting photosensitive coating solution was worked as in Example 1 to make a photoconductor. The characteristics of the sample were measured and the results are summarized in Table 8.

TABLE 8

| Example | $V_{0(V)}$ | $V_{10(V)}$ | $V_{10}/V_0$ | $E_{\frac{1}{2}}$ (lux. sec) | $E_{1/5}$ (lux. sec) | $E_{\frac{1}{2}}$ at 830 nm ($\mu J/cm^2$) | $V_{15(V)}$ |
|---|---|---|---|---|---|---|---|
| 11 | −640 | −560 | 0.88 | 5.0 | 9.0 | 1.6 | 0 |
| 12 | −680 | −590 | 0.87 | 6.0 | 11.0 | 1.8 | 0 |

The photoconductors of photosensitive coating solutions prepared in Examples 1 to 12 may be processed to make printing plates as shown below.

APPLICATION 1

A toner image was formed on the surface of each photoconductor using a surface treated aluminum plate as a support. After fixing the toner image, the surface of the photoconductor in the non-image area was removed by development to make a printing plate. The electrophotographic copier used in these procedures was equipped with an InGaAl P semiconductor laser (osillating at 830 nm) as a recording light source. The toner image was formed with an electrophotographic liquid toner, CBR-105 which was the product of Dainippon Ink And Chemicals, Inc. The toner image thus formed has excellent alkali resistance, and is insoluble in the following alkaline developing solution. Image and non-image areas were formed by developing the photoconductor's surface with a Decoating Solution 872 (alkaline developing solution produced by Polychrome Corporation) after being diluted 12-fold with water. Each of the printing plates thus prepared was set on a lithographic printing press and subjected to a printing test. Each plate had long runs and produced printed matter of high quality.

APPLICATION 2

Each of the photosensitive coating solutions prepared in Examples 1 and 12 was applied to paper that had been rendered electrically conductive. The webs were dried to make samples of photosensitive paper each having a photosensitive layer with a thickness of 15 μm. Printing plates were prepared from the pre-sensitized paper samples using an electrophotographic copier and a toner which were the same as those employed in Application 1. Image and non-image areas were formed by processing the paper samples with a Tokyo Fax Etching Solution of Tomoegawa Paper Mfg. Co., Ltd. which was designed for processing a ZnO offset master.

Each of the printing plates thus prepared was set on a lithographic printing press and subjected to a printing test, with Tokyo Fax Etching Solution being supplied as dampening solution after 5-fold dilution with water. Each plate had long runs and produced printed matter of high quality.

The electrophotoconductor of the present invention can be manufactured at a low cost and yet exhibits high sensitivity to light at wavelengths within the operating range of a semiconductor laser. As further advantages, the photoconductor of the present invention can be used as a material for making printing plates and is particularly adaptive to platemaking with a semiconductor laser being used as a recording light source.

While the invention has been described in detail and with reference to specific embodiments thereof, it will be apparent to one skilled in the art that various changes and modifications can be made therein without departing from the spirit and scope thereof.

What is claimed is:

1. An electrophotoconductor comprising a photosensitive layer containing (a) a zinc oxide compound, (b) a phthalocyanine compound in an amount between 0.1 and 30 parts by weight per 100 parts by weight of zinc oxide compound, (c) a hole transporting material selected from the group consisting of oxidiazole compounds, N-alkylcarbazole compounds, dialkylaminobenzoic acid compounds and indole compounds in an amount between 0.1 and 30 parts by weight and (d) a binder resin in an amount between 10 and 100 parts by weight.

2. A photoconductor according to claim 1, wherein said zinc oxide compound (a) is dye-sensitized zinc oxide.

3. A photoconductor according to claim 1, wherein said phthalocyanine compound (b) is a metallic phthalocyanine compound containing titanium, vanadium, aluminum, magnesium or copper as the central metal.

4. A photoconductor according to claim 1, wherein said hole transporting material (c) is an oxadiazole compound.

5. A photoconductor according to claim 4, wherein said oxadiazole compound has the formula:

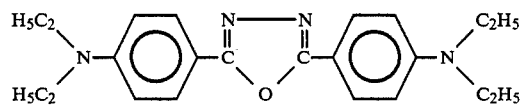

* * * * *